US011377881B2

(12) United States Patent
Bartola et al.

(10) Patent No.: US 11,377,881 B2
(45) Date of Patent: Jul. 5, 2022

(54) LOCK FOR MOTOR VEHICLE HOOD

(71) Applicant: CEBI ITALY S.P.A., Osimo Stazione (IT)

(72) Inventors: Roberto Bartola, Ancona (IT); Alessandro Gioacchini, Ancona (IT)

( * ) Notice: Subject to any disclaimer, the term of this patent is extended or adjusted under 35 U.S.C. 154(b) by 126 days.

(21) Appl. No.: 16/960,835

(22) PCT Filed: Oct. 24, 2018

(86) PCT No.: PCT/EP2018/079189
§ 371 (c)(1),
(2) Date: Jul. 8, 2020

(87) PCT Pub. No.: WO2019/141394
PCT Pub. Date: Jul. 25, 2019

(65) Prior Publication Data

US 2020/0399936 A1 Dec. 24, 2020

(30) Foreign Application Priority Data

Jan. 17, 2018 (IT) ..... 102018000001207

(51) Int. Cl.
*E05B 79/20* (2014.01)
*E05B 83/24* (2014.01)
(Continued)

(52) U.S. Cl.
CPC ..... *E05B 79/20* (2013.01); *E05B 81/20* (2013.01); *E05B 83/24* (2013.01); *E05B 81/64* (2013.01)

(58) Field of Classification Search
CPC ..... E05B 79/20; E05B 81/64; E05B 81/18; E05B 81/20; E05B 81/66; E05B 81/70;
(Continued)

(56) References Cited

U.S. PATENT DOCUMENTS 3,905,624 A 9/1975 Fujita
5,738,393 A * 4/1998 Chao ..... E05B 83/24 292/216
(Continued)

FOREIGN PATENT DOCUMENTS

CN 107489321 A * 12/2017 ..... E05B 83/243
DE 102007003292 A1 7/2008
(Continued)

OTHER PUBLICATIONS

English Translation for CN 107489321 A (Year: 2017).*
International Search Report for corresponding PCT/EP2018/079189.
Written Opinion of the ISA for corresponding PCT/EP2018/079189.

*Primary Examiner* — Alyson M Merlino
(74) *Attorney, Agent, or Firm* — Egbert, McDaniel & Swartz, PLLC

(57) ABSTRACT

A lock for a motor vehicle hood having a catch suitable for fastening a striker, a pawl that cooperates with the catch in order to block the catch in closing position, a safety lever that guarantees the additional closing of the striker, a first spring that stresses the catch towards an opening position, a second spring that stresses the pawl towards a closing position, a third spring that stresses the safety lever towards closing position, a first Bowden cable connected to the pawl to pull the pawl towards the opening position, and a second Bowden cable connected to the safety lever to pull the safety lever towards the opening position.

6 Claims, 12 Drawing Sheets

(51) Int. Cl.
*E05B 81/20* (2014.01)
*E05B 81/64* (2014.01)

(58) Field of Classification Search
CPC ..... E05B 83/24; E05B 83/16; E05B 83/18; E05B 85/20; E05B 85/24; E05B 85/26; Y10T 292/1047; Y10T 292/1082; Y10S 292/14; Y10S 292/42; Y10S 292/43
See application file for complete search history.

(56) References Cited

U.S. PATENT DOCUMENTS

| | | | | | |
|---|---|---|---|---|---|
| 5,868,444 | A * | 2/1999 | Brackmann | ..... | E05B 81/20 292/216 |
| 7,210,714 | B2 * | 5/2007 | Berghahn | ..... | E05B 81/20 292/216 |
| 10,669,751 | B2 * | 6/2020 | Kim | ..... | E05B 83/24 |
| 11,220,848 | B2 * | 1/2022 | Chevalier | ..... | E05B 83/24 |
| 2012/0161456 | A1 * | 6/2012 | Riedmayr | ..... | E05B 83/24 292/226 |
| 2016/0340941 | A1 * | 11/2016 | Taurasi | ..... | E05B 83/24 |
| 2017/0159330 | A1 * | 6/2017 | Schiffer | ..... | E05B 83/24 |
| 2017/0306661 | A1 * | 10/2017 | Kim | ..... | E05B 83/24 |
| 2019/0218833 | A1 * | 7/2019 | Nelsen | ..... | E05B 83/24 |
| 2021/0095499 | A1 * | 4/2021 | Sturm | ..... | E05B 83/24 |

FOREIGN PATENT DOCUMENTS

| | | | | | |
|---|---|---|---|---|---|
| DE | 102009010975 | A1 * | 9/2010 | ..... | E05B 83/24 |
| DE | 102016208637 | A1 | 11/2016 | | |
| DE | 202017000456 | U1 | 2/2017 | | |
| DE | 202017105394 | U1 | 9/2017 | | |
| FR | 2889230 | A1 * | 2/2007 | ..... | E05B 83/16 |

* cited by examiner

LOCK FOR MOTOR VEHICLE HOOD

RELATED U.S. APPLICATIONS

Not applicable.

BACKGROUND OF THE INVENTION

1. Field of the Invention

The present patent application for industrial invention relates to a lock for motor vehicle hood.

2. Description of Related Art Including Information Disclosed Under 37 CFR 1.97 and 37 CFR 1.98

Various types of locks for motor vehicle hoods are known on the market. The term "hood" refers to the lid disposed in the front of the vehicle. Said locks comprise a catch that is engaged into an "U"-shaped striker fixed to the body of the vehicle.

The catch is moved by an actuator by means of lever mechanisms. A stop lever, which is normally called pawl, is engaged with the catch in order to lock the catch and hold it in closed position.

Such types of locks of the prior art are not very versatile because they cannot adjust to different types of electrical or mechanical actuation commands.

It must be considered that according to the legislation in force and to the market requirements, two actions are necessary to open the hood completely: a first partial opening of the lock by means of a command given by the user in the interior of the vehicle, and a second complete opening of the lock by means of another command given by the user in the front of the vehicle.

Moreover, it must be considered that in the case of electrical cars or cars with motor in the back, the hood covers a compartment in which a child might enter; in some cases, the legislation requires the presence of a manual actuation lever inside the compartment of the hood in order to open the lock.

The locks of the prior art are not capable of coordinating efficiently and efficaciously the various types of mechanical and/or electronic opening commands given by the user and eventually by the child inside the hood compartment.

BRIEF SUMMARY OF THE INVENTION

The purpose of the present invention is to eliminate the drawbacks of the prior art by providing a lock for a vehicle hood that is versatile and suitable for adjusting to different types of opening commands and suitable for operating in exclusively mechanical mode.

Another purpose of the present invention is to disclose such a lock for motor vehicle hood that is reliable, efficient and effective.

Advantageous embodiments of the invention appear from the dependent claims.

Additional features of the invention will appear clearer from the detailed description below, which refers to merely illustrative, not limiting embodiments, wherein:

Figure 1:
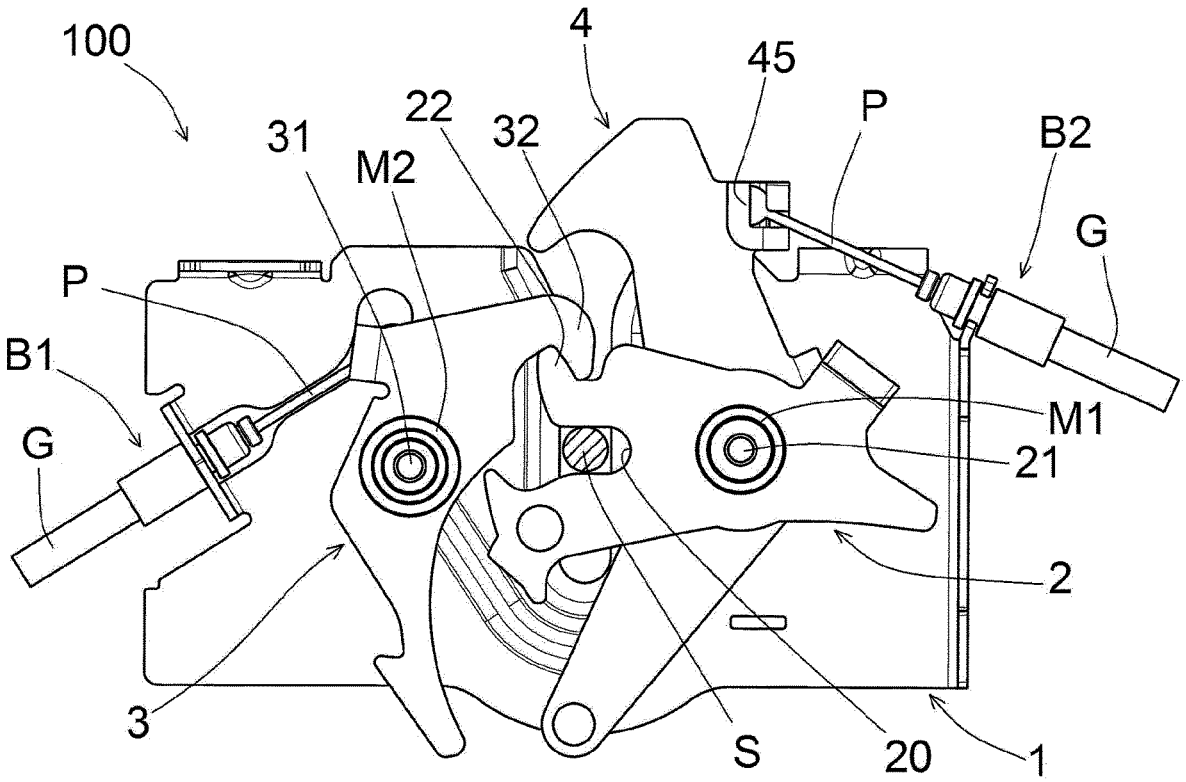
FIGS. 1, 2 and 3 are plan views of the lock of the invention, respectively in complete closing position, in partial closing position and in opening position.

With reference to the Figures, the lock of the invention is disclosed, which is generally indicated with reference numeral (100).

DETAILED DESCRIPTION OF THE INVENTION

With reference to FIGS. 1, 2, 3 and 7, the lock (100) comprises a catch (2) suitable for fastening a striker (S) which generally has a "U"-shape in order to close the lock. The striker (S) is fixed to the body of the vehicle. Instead the lock (100) is disposed in a box (1) fixed to the hood of the vehicle. Obviously, the lock can be fixed to the body of the vehicle and the striker (S) can be integral with the hood.

A U-shaped slot (10) is obtained in the box (1) to let the striker (S) pass through.

The body of the catch (2) is shaped as a plate provided with a "U"-shaped slot (20) that is suitable for fastening the striker (S).

Figure 2:
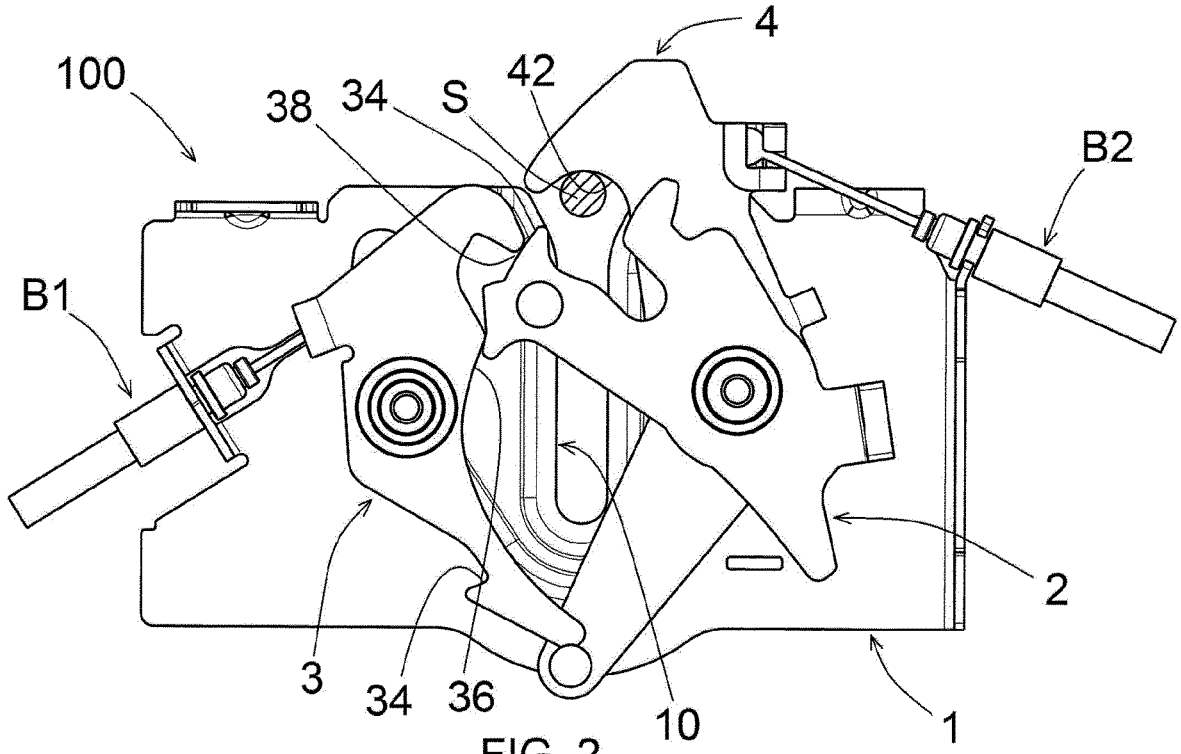
Figure 3:
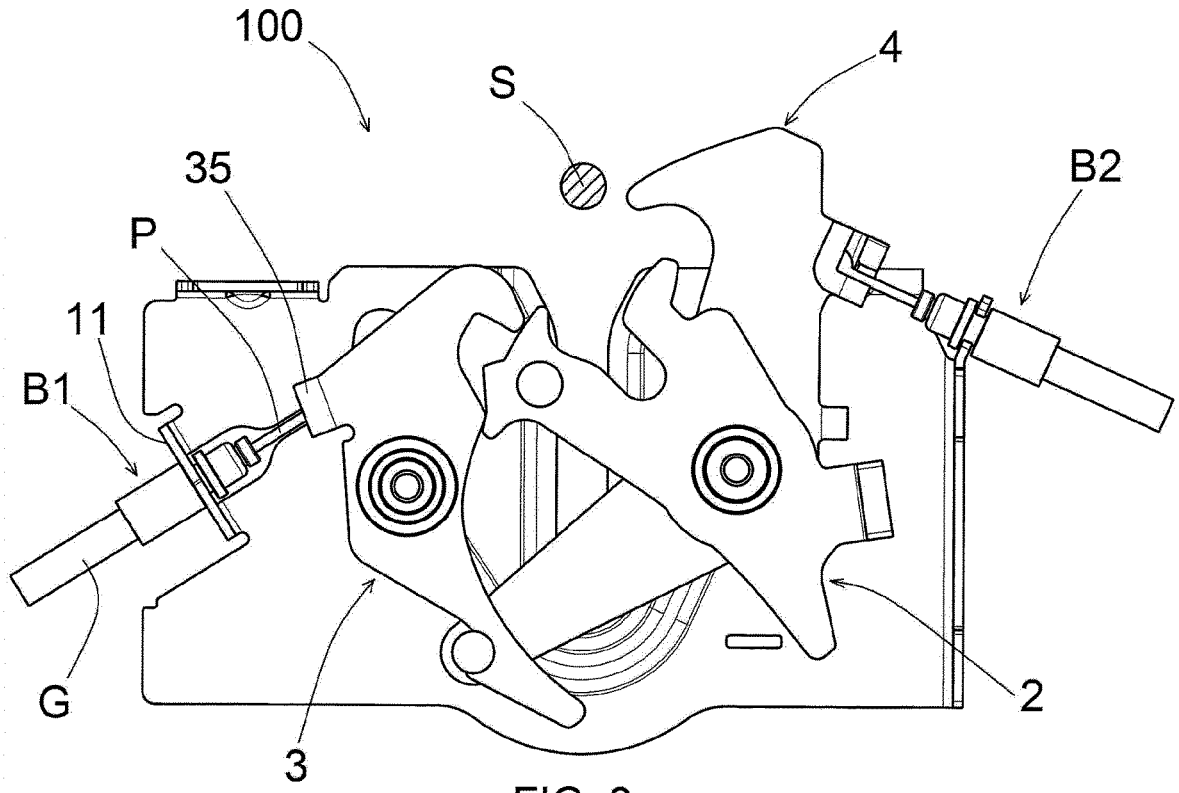

The catch (2) is hinged to the box by means of a pivoting pin (21), in such a way as to move from the closed position (FIG. 1) to an open position (FIGS. 2 and 3).

The catch (2) has stop means (A) comprising a stop tooth (22) that projects outwards from one side of the fastening slot (20). The stop tooth defines a stop seat (23) with concave shape on one edge of the catch.

The catch (2) has stop means (C) comprising a stop surface (24) disposed near the fastening slot (20) from the opposite side relative to the stop tooth (22).

The catch (2) has cam means (D) comprising a cam surface (26) disposed near a stop surface (24).

The catch (2) comprises a pin (25) that projects from the catch, near the stop surface (24) and parallel to the pivoting pin (21).

The catch (2) is stressed by a spring (M1) that pushes the catch (2) towards its opening position, i.e. in anti-clockwise rotation compared to the figures.

A pawl (3) is hinged to the box (1) by means of a pivoting pin (31) parallel to the pivoting pin (21) of the catch, in such a way as to move from an opening position (FIGS. 2 and 3) to a closing position (FIG. 1).

The pawl (3) has a first arm (30*a*) and a second arm (30*b*) relative to the pivoting pin (31). The pawl (3) interacts with the catch (2) in order to lock the catch (2) in a closing position (FIG. 1).

The pawl (3) has stop means (A') comprising a stop tooth (32) disposed in the first arm (30*a*) and facing the catch (2). The stop tooth (32) of the pawl defines a stop seat (33) with concave shape.

The catch (3) has stop means (C') comprising a stop surface (38) disposed near the stop tooth (32).

The pawl (3) has cam means (D') comprising a cam surface (36) disposed on one edge of the first arm (30*a*) of the pawl.

The pawl (2) is stressed by a spring (M2) that pushes the pawl towards its locking position, i.e. In clockwise direction.

With reference to FIG. 1, when the catch (2) is in closing position, the retention tooth (32) of the pawl is in the retention seat (23) of the catch and the stop tooth (22) of the catch is in the stop seat (33) of the pawl, in such a way as to prevent the catch (2) from being opened from the closing position. On the contrary, when the catch (2) is in an opening position (FIGS. 2 and 3), the stop surface (38) of the pawl is stopped against the stop surface (24) of the catch, in such a way as to hold the pawl (3) in the opening position.

A fastening seat (34) with concave shape is obtained in the second arm (30*b*) of the pawl, on an opposite edge relative to the stop tooth (32).

A flange (35) is obtained on the first arm (30*a*) of the pawl in distal position from the stop tooth (32). A first Bowden cable (B1) is connected to the flange (35) of the pawl and to an actuator (not shown in the figures). The actuator can be of electric type, such as an electric motor, or a linear actuator or a mechanical actuator, such as a lever or handle that can be actuated manually by the user. The Bowden cable (B1) comprises an internal cable (P) fixed to the flange (35) of the pawl. The internal cable (P) is slidably mounted in an external tube (G) fixed to a flange (11) of the box.

The lock (100) comprises a safety lever (4) suitable for interacting with the striker (S) in order to lock the striker (S) in a partial closing position of the lock (FIG. 2) and with the pawl (3) in order to fasten the pawl and remain in opening position (FIG. 3).

The safety lever (4) is pivoted to the box by means of a pivoting pin (41) parallel to the pivoting pin (31) of the pawl and coaxial to the pivoting pin (21) of the catch, in such a way that the safety lever can move from an opening position (FIG. 3) to a closing position (FIGS. 1 and 2).

The safety lever comprises a first arm (40*a*) and a second arm (40*b*) relative to the pivoting pin (41). The two arms (40*a*, 40*b*) are inclined by an obtuse angle. A spring (M3) stresses the safety lever (4) in closing position, i.e. in anticlockwise direction with reference to the figures.

The safety lever (4) comprises a blocking seat (42) disposed in the first arm (40*a*) and suitable for blocking the striker (S) when the lock is in temporary closing position (FIG. 2).

A fastening pin (44) is provided in the second arm (40*b*) of the safety lever and is suitable for being fastened in the fastening slot (34) of the pawl, when the lock is open (FIG. 3) in order to hold the safety lever (4) in opening position.

A flange (45) is obtained on the first arm (40*a*) of the safety lever in distal position from the blocking seat (42). A second Bowden cable (B2) is connected to the flange (45) of the safety lever and to an actuator (not shown in the figures). The actuator can be an electric actuator, such as an electric motor, or a linear actuator or a mechanical actuator, such as a lever or handle that can be actuated manually by the user. The second Bowden cable (B2) comprises an internal cable (P) fixed to the flange (45) of the safety lever. The internal cable (P) is slidably mounted in an external tube (G) fixed to a flange (12) of the box.

With reference to FIGS. 1, 2 and 3 the operation of the lock (100) of the invention is described.

With reference to FIG. 1, the lock (100) is completely closed. The catch (2) is in closing position with the fastening slot (20) that fastens the striker. The pawl (3) is in closing position, wherein it locks the catch (2). The safety lever (4) is in closing position, wherein the blocking seat (42) is above the slot (10) of the box.

First, the pawl (3) is actuated by pulling the first Bowden cable (B1), causing a rotation of the pawl in anticlockwise direction. Consequently, the pawl (3) releases the catch (2).

As shown in FIG. 2, because of the action of the first spring (M1), the catch (2) rotates in clockwise direction towards its opening position, releasing the striker (S), which is stopped in the blocking seat (42) of the safety lever, preventing the complete opening of the hood. In such a situation, there is provided a partial closing of the lock. It must be noted that, because of the action of the second spring (M2), the pawl (3) is stopped against the stop surface (24) of the catch and remains in opening position.

Successively, the safety lever (4) is actuated by pulling the second Bowden cable (B2), which determines the clockwise rotation of the safety lever (4) towards its opening position, in such a way as to release the catch (2) (as shown in FIG. 3) and open the hood completely. It must be noted that the fastening pin (44) of the safety lever is fastened in the fastening seat (34) of the pawl, holding the safety lever in opening position.

For closing said lock, by pushing the hood down, the striker (S) pushes the catch (2), rotating it in anticlockwise direction towards the closing position. Then the striker (S) penetrates the fastening slot (20) of the catch.

The came surface (26) of the catch slides on the cam surface (36) of the pawl, making the pawl rotating in anticlockwise direction, in such a way that the fastening pin (44) of the safety lever is released from the fastening seat (34) of the pawl. Consequently, being pushed by the third spring (M3), the safety lever (4) rotates in anticlockwise direction and is disposed in closing position. Being pushed by the second spring (M2), the pawl (3) rotates in clockwise direction towards the closing position, wherein it locks the catch.

Figure 4:
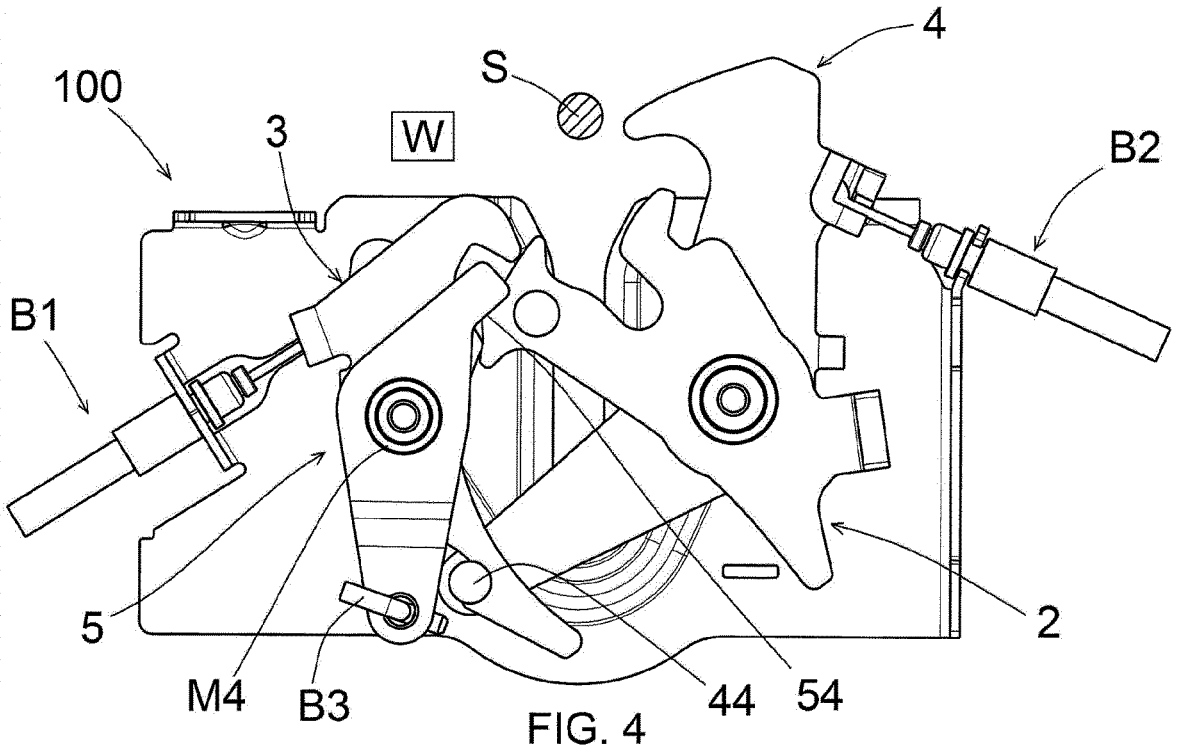
FIGS. 4, 5 and 6 are plan views of an improved lock of the invention, respectively in opening position, in an initial closing condition and in a final closing position.
Figure 5:
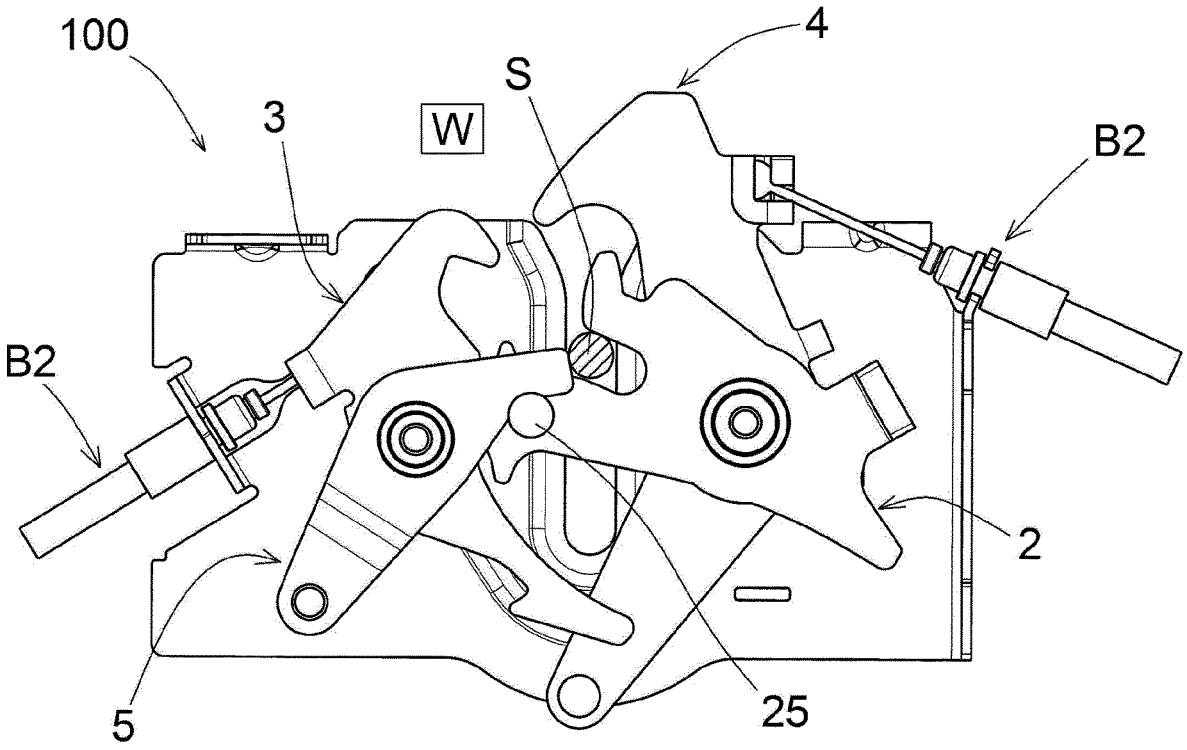
Figure 7:
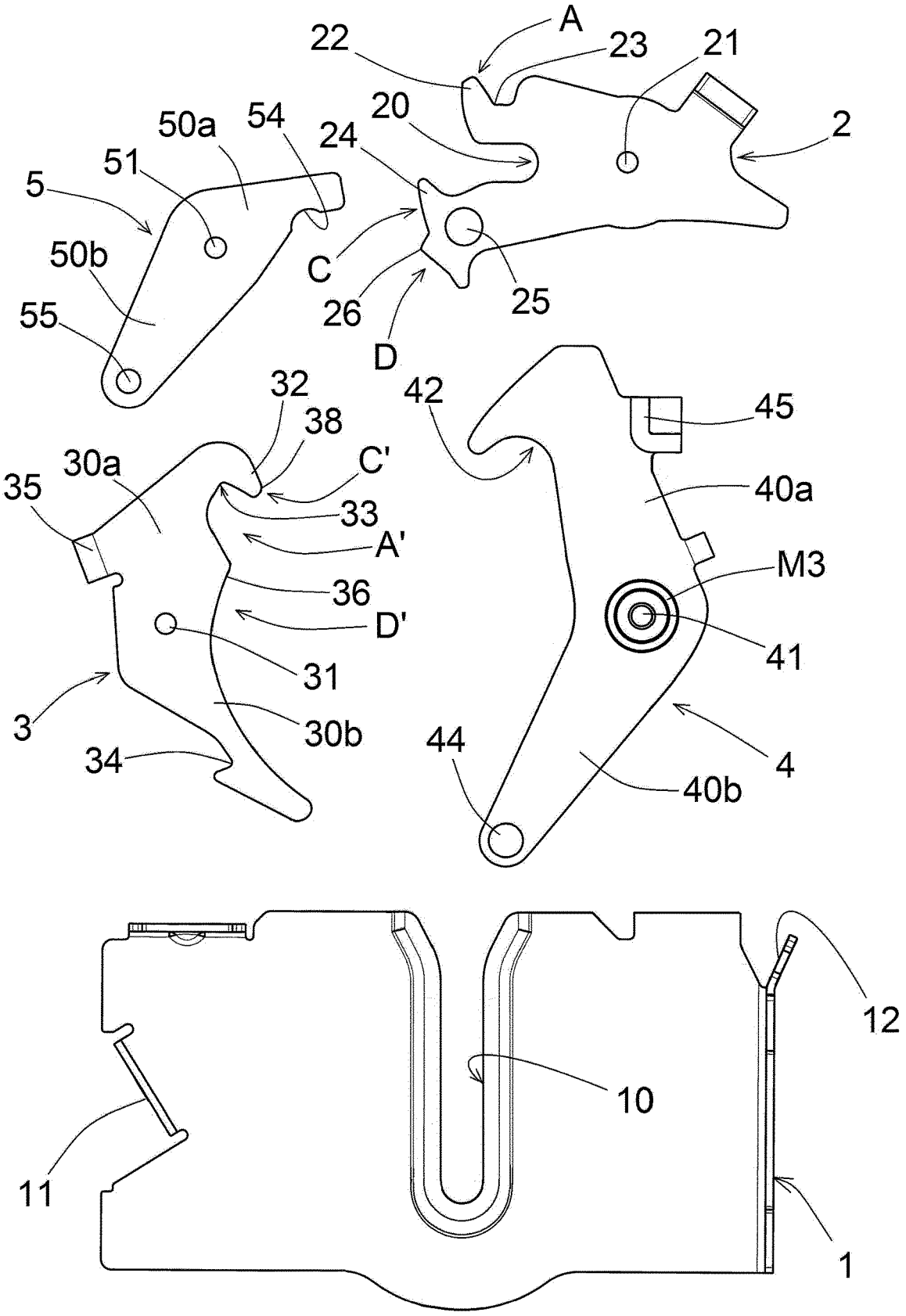
FIG. 7 is an exploded plan view of the various parts of the lock of FIG. 4.

With reference to FIGS. 4,5 and 7, optionally the lock (100) may comprise an auxiliary lever (5) suitable for interacting with the catch (2) to move it in closing position.

Figure 6:
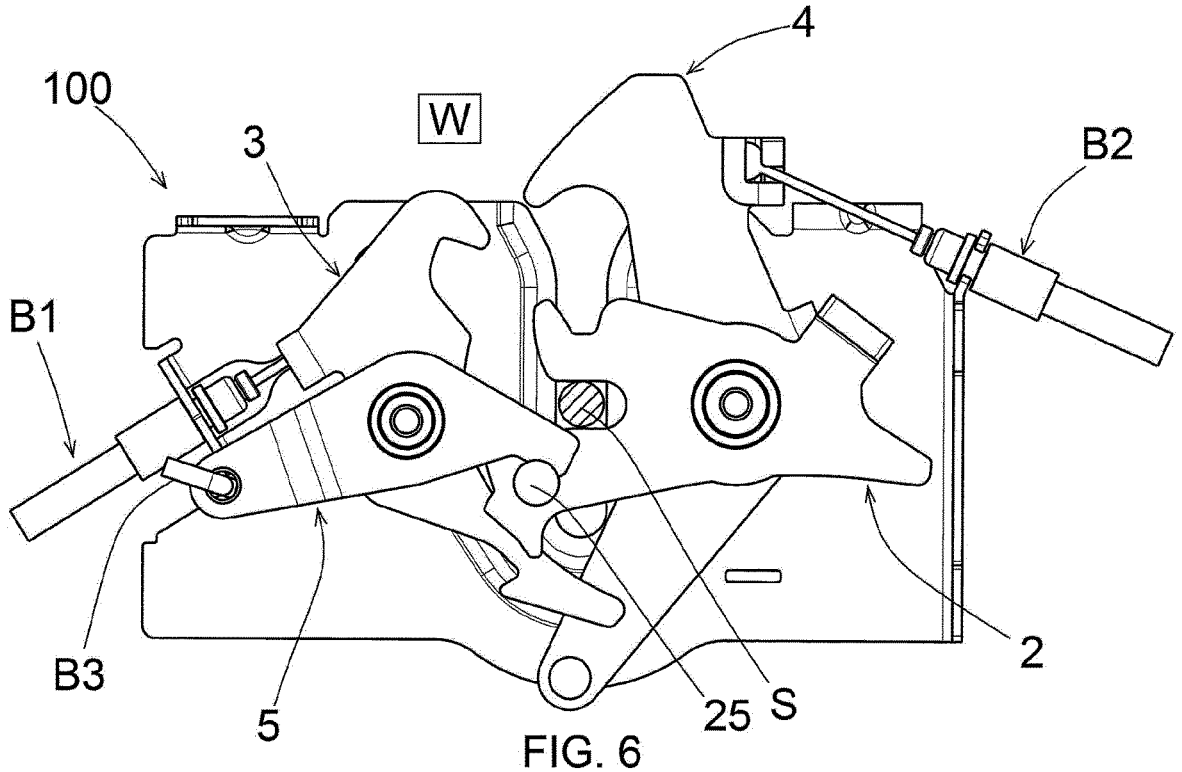

The auxiliary lever (5) is pivoted to the box by means of a pivoting pin (51) that is parallel to the pivoting pin (31) of the catch and coaxial to the pivoting pin (31) of the pawl. In view of the above, the auxiliary lever (5) can be moved from an opening position (FIG. 4), wherein the auxiliary lever (5) does not interact with the catch, towards a closing position (FIGS. 5 and 6) wherein the auxiliary lever (5) pushes the catch (2) towards its closing position.

The auxiliary lever (5) comprises a first arm (50*a*) and a second arm (50*b*) relative to the pivoting pin (51). The two arms (50*a*, 50*b*) are inclined by an obtuse angle. A fourth spring (M4) stresses the auxiliary lever (5) towards the opening position (FIG. 4), i.e. In anticlockwise direction with reference to the figures.

The auxiliary lever (5) comprises a stop seat (54) disposed in the first arm (50*a*) and suitable for being stopped against the pin (25) of the catch to push the catch towards its closing position.

A flange or hole (55) is obtained on the second arm (50*b*) of the auxiliary lever. A third Bowden cable (B3) is connected to the flange (55) of the auxiliary lever and to an actuator (not shown in the figures). Said actuator of the auxiliary lever is connected to a position sensor (W) suitable for detecting the position of the striker (S) when the striker (S) penetrates the fastening seat (20) of the catch. The position sensor (W) sends a command signal to the actuator, which pulls the third Bowden cable (B3), moving the auxiliary lever (5) towards the closing position, wherein the auxiliary lever pushes the catch (2) towards its closed position. The movement of the catch (2) determines a movement of the pawl (3) that releases the safety lever (4), which returns to the closed position because of the action of the third spring (M3). The pawl (3) returns to the closed position because of the action of the second spring (M2).

With reference to FIGS. 8-19 a lock (200) is described according to a second embodiment of the invention, wherein the parts that are identical or corresponding to the parts described above are identified with the same numerals, omitting their detailed description.

Figure 8:
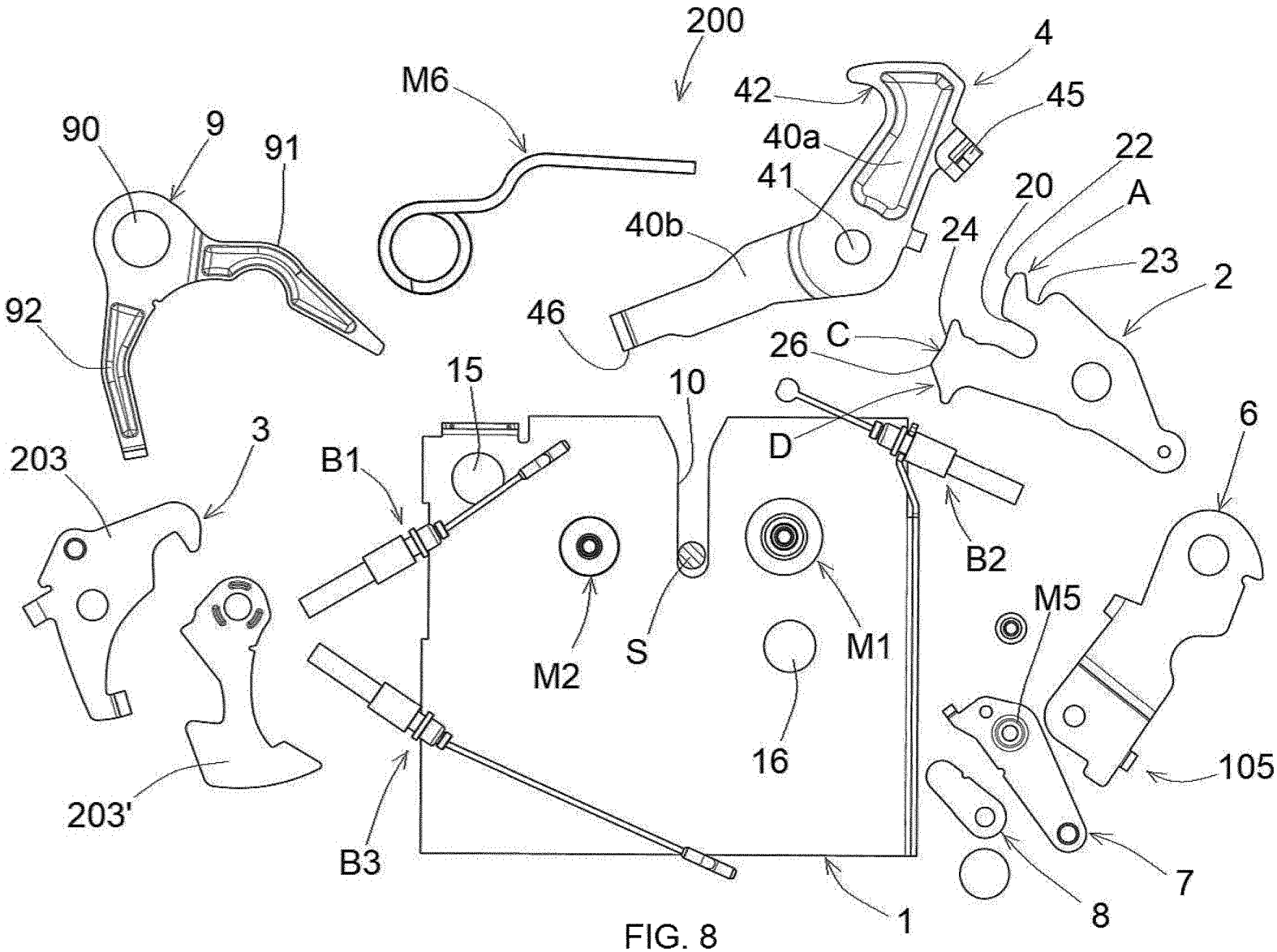
FIG. 8 is an exploded plan view of the various parts of a second embodiment of the lock of the invention.
Figure 9:
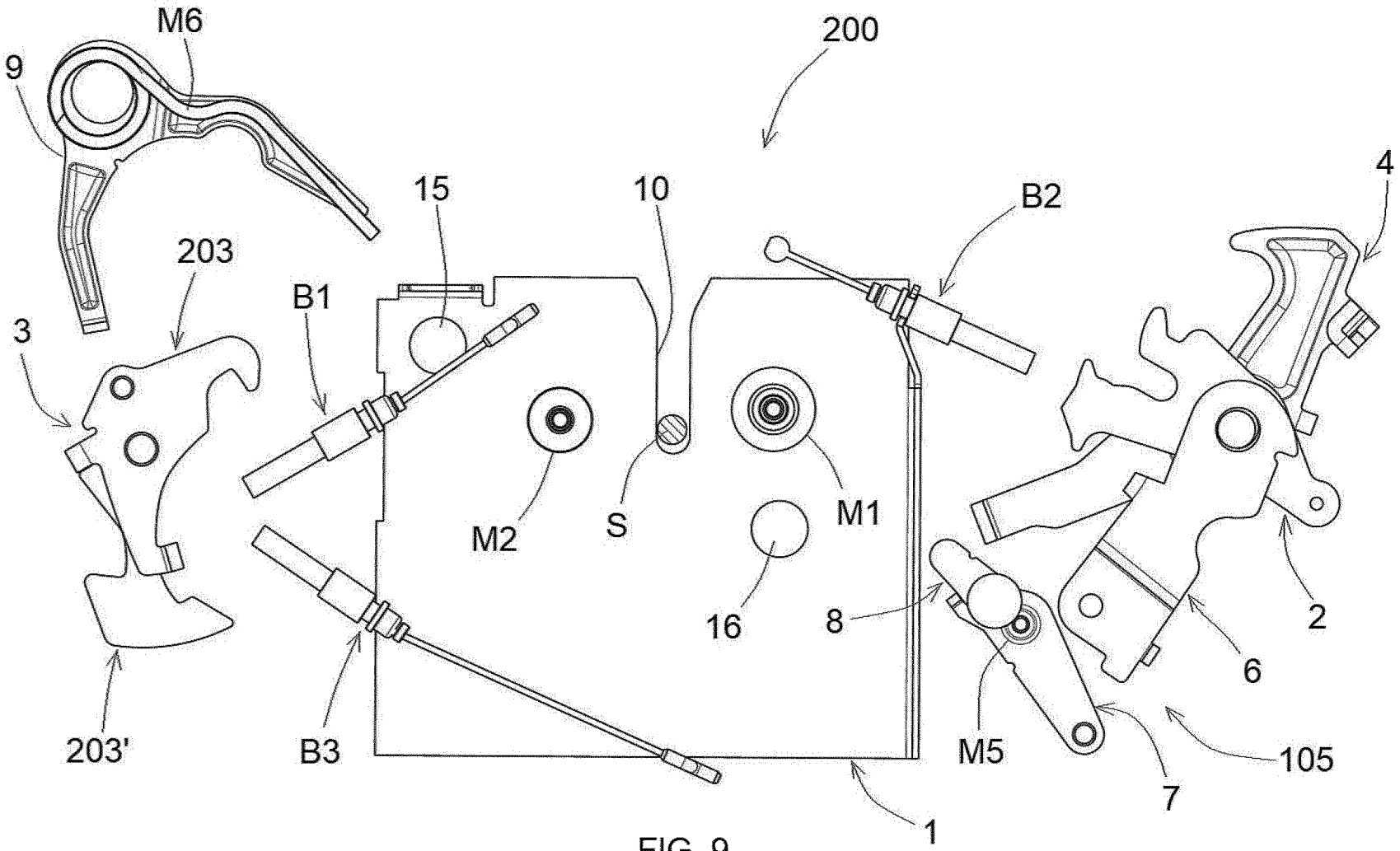
FIG. 9 is the same view as FIG. 8, wherein some parts are assembled.

In particular, with reference to FIGS. 8 and 9, the lock (200) has a catch (2) that is substantially identical to the catch of the lock (100).

Figure 8A:
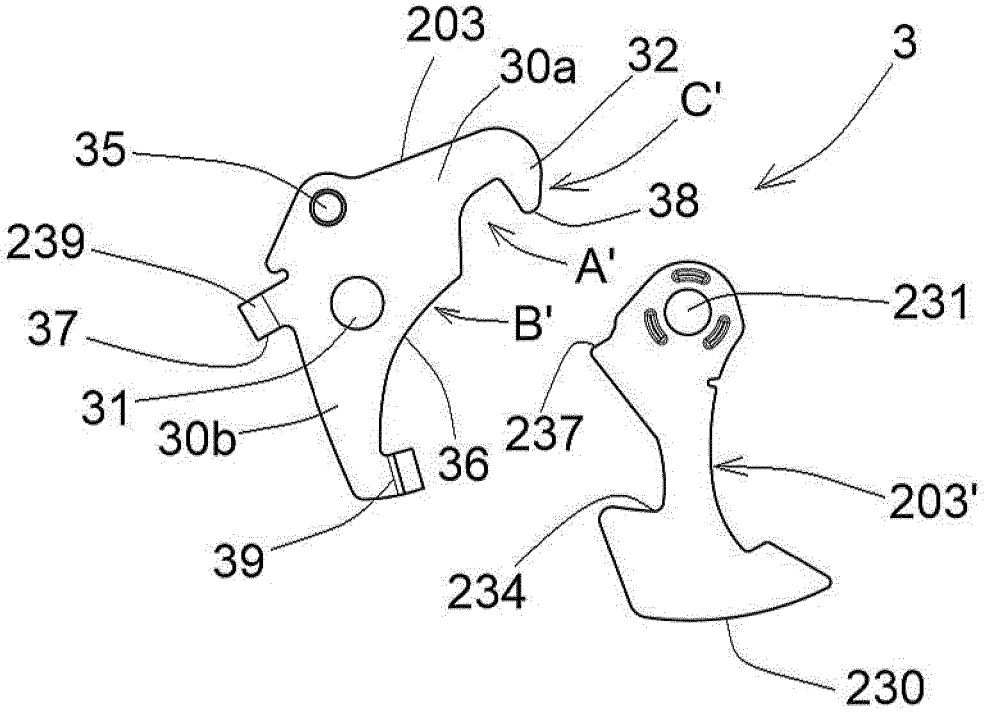
FIGS. 8A and 8B are two enlarged views of FIG. 8 which show the pawl and the lever mechanism in detail.

With reference to FIG. 8A, the lock (200) comprises a pawl (3) having a first element (203) that is substantially similar to the pawl of the lock (100). The first element (203) of the pawl (3) comprises the retention means (A'), the stop means (C') and the cam means (D').

The first element (203) of the pawl (3) has a first projection (39) disposed at the end of the second arm (30*b*) of the first element of the pawl and a second projection (37) disposed in an intermediate position near the pivoting pin (31) of the pawl.

The pawl (3) comprises a second element (203') hinged to the first element (203) by means of a pivoting hole (231) disposed in the pivoting pin (31).

The second element (203') of the pawl has a curved cam surface (230) that goes to a seat (234). The cam surface (230) is distal from the pivoting hole (231)

The second element (203') of the pawl has a stop surface (237) disposed above the seat (234) near the pivoting hole (231). A spring is disposed between the two elements (203, 203') of the pawl.

Going back to FIG. 8, the lock (200) has a safety lever (4) that is substantially identical to the safety lever of the lock (100). The safety lever (4) of the lock (200) is not provided with the fastening pin (44). The safety lever (4) of the lock (200) has a stop projection (46) at the end of the second arm (40*b*).

The auxiliary lever (5) of the first embodiment is omitted and replaced by a lever mechanism (105) suitable for being connected to a kid lever disposed inside the hood.

Figure 8B:
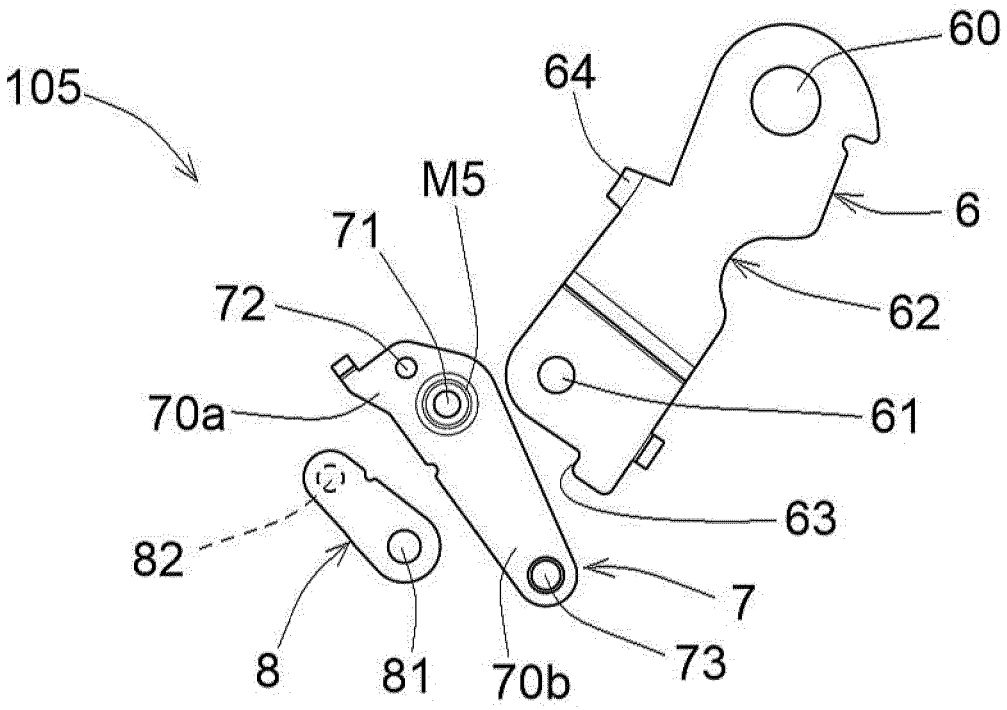

With reference to FIG. 8B, the lever mechanism (105) comprises a first lever (6), a second lever (7) and a third lever (8) that are hinged mutually.

The first lever (6) has a first hole (60) and a second hole (61) disposed at the ends of the first lever.

The first hole (60) of the first lever is hinged in the same pivoting pin (21) of the catch (2) and of the safety lever (4).

The second hole (61) of the first lever is hinged into a pivoting pin (71) of the second lever (7) of the lever mechanism.

The first lever (6) has an arched seat (62) that rests on a pin (16) integral with the box. A spring pushes the first lever towards the pin (16) of the box.

The first lever (6) of the lever mechanism has a first stop surface (63) disposed at one end near the second hole (61). The first stop surface (63) of the first lever is suitable for being stopped against the stop projection (46) of the safety lever (4).

The first lever (6) of the lever mechanism has a second stop surface (64) disposed in intermediate position. The second stop surface (64) of the first lever is suitable for being stopped against the first projection (39) of the first element of the pawl.

The second lever (7) of the lever mechanism is hinged to the first lever by means of the pin (71). So, the second lever (7) has two arms (70*a*, 70*b*).

The pin (71) projects from the second lever (7) and acts as fastening pin. In fact, the pin (71) of the second lever is suitable for sliding on the cam surface (230) of the second element of the pawl and engaging in the seat (234) of the second element of the pawl.

A spring (M5) is disposed around the pin (71) of the second lever in order to stress the second lever (7) in anticlockwise rotation.

The first arm (70*a*) of the second lever has a pin (72) that is hinged in a hole (81) of the third lever (8).

The second arm (70*b*) of the second lever has a hole (73) wherein a third Bowden cable is fixed (B3). The third Bowden cable (B3) is connected to a kid lever (L) (FIG. 13), disposed in the hood of the vehicle.

The third lever (8) of the lever mechanism has a projecting pin (82) disposed in distal position from the pivoting pin (81). The projecting pin (82) of the third lever is suitable for being stopped against the first projection (39) of the first element of the pawl.

Going back to FIG. 8, the lock (200) comprises a spring (M6) disposed in the box (1) and acting on the striker (S) in such a way to stress the striker (S) and eject it from the slot (10) of the box.

The lock (200) comprises a reset device (9) with a "U" shape. The reset device (9) has a hole (90) disposed in a pin (15) of the box.

The reset device (9) comprises:

- a first arm (91) suitable for being disposed under the striker (S) when the striker (S) is in closed position, and
- a second arm (92) suitable for pushing the second element (203') of the pawl to reset the lever mechanism (105) when the hood is opened and the striker (S) releases the first arm (91) of the reset device, which can rotate in anticlockwise direction by means of a spring (not shown in the drawings).

The striker (S) is always disposed above the first arm (91) of the reset device (9). When the hood is closed, the striker (S) pushes the first arm (91) of the reset device (9) against the action of the spring of the reset device.

Figure 10:
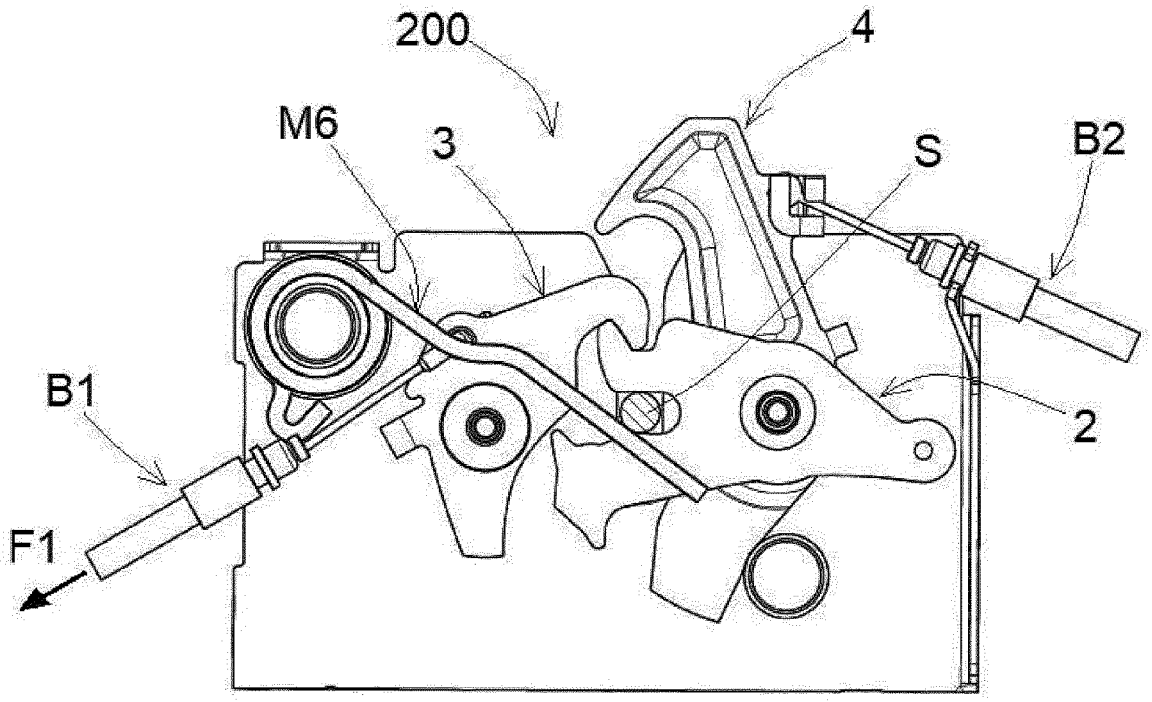
FIGS. 10, 11 and 12 are plan views of the lock of FIG. 8, in a minimum configuration, respectively in complete closing position, partial closing position and opening position.

FIG. 10 shows the lock (200) in closed position in a minimum configuration comprising: the striker (2), the first element (203) of the pawl and the safety lever (4).

In order to open the lock, the first Bowden cable (B1) is pulled in the direction of the arrow F1; so, the pawl (3) rotates and releases the striker (2). Consequently, the striker (S) is moved.

Figure 11:
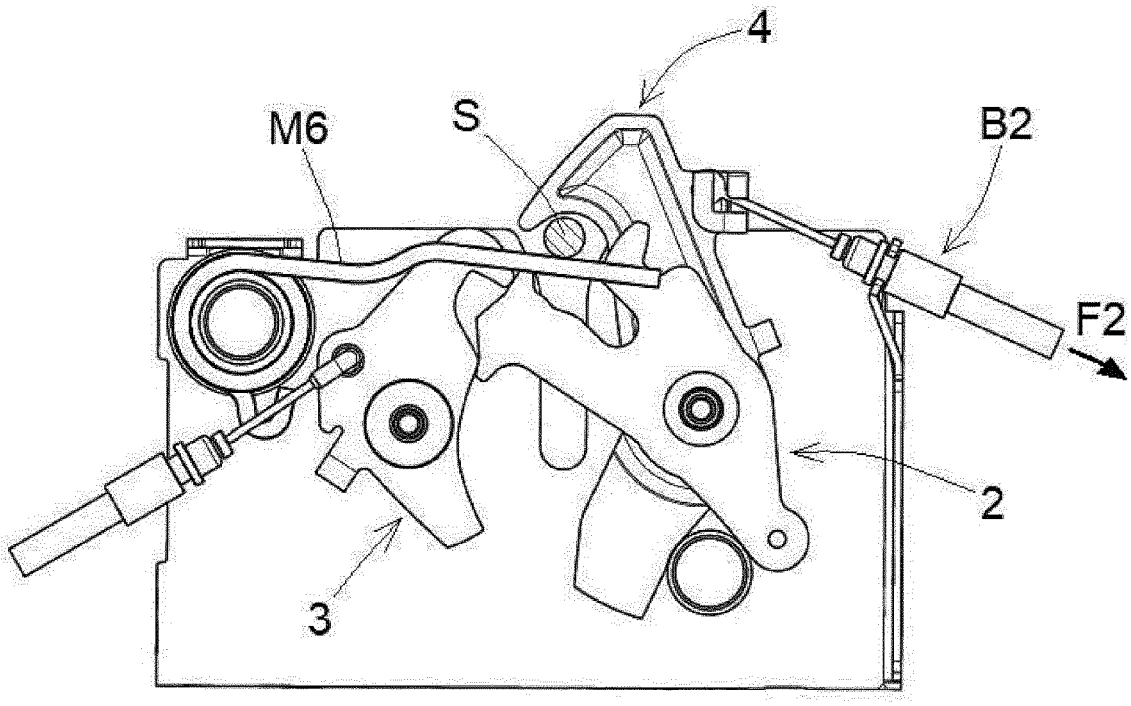
Figure 12:
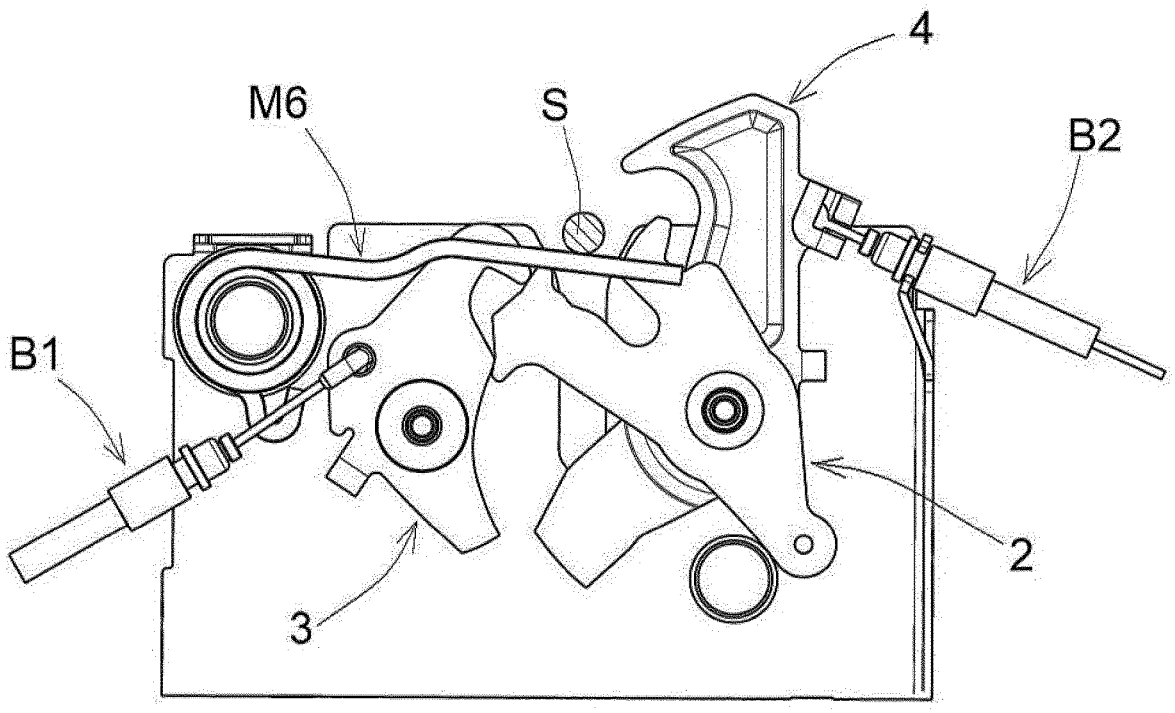

FIG. 11 shows the striker (S) stopped against the safety lever (4) in partially open position, wherein the lid of the hood cannot be open. Now, the second Bowden cable (B2) is pulled in the direction of the arrow F2; so, the safety lever (4) rotates and releases the striker (S), permitting the total opening of the lock, as shown in FIG. 12, and the lid of the hood can be opened.

Figure 13:
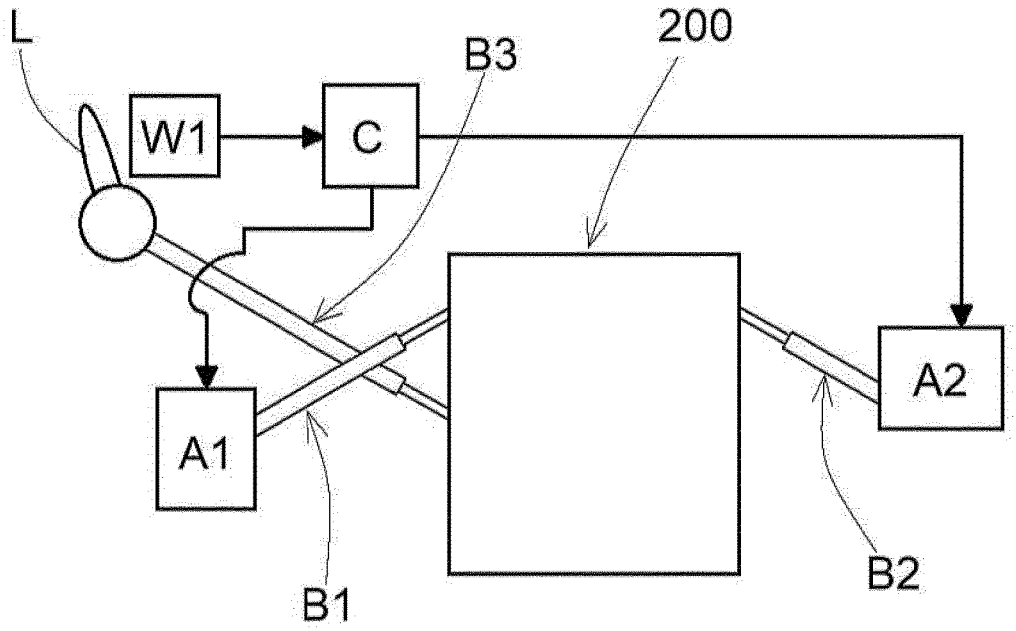
FIG. 13 is a block diagram that shows the connections of the lock of FIG. 8.

With reference to FIG. 13, a sensor (W1), such as a microswitch, is coupled with the kid lever (L) to detect its actuation. The kid lever (L) is regulated in such a way that during its initial movement it does not pull the Bowden cable (B3), but said initial movement is detected by the sensor (W).

The sensor (W) is electrically connected to a control processing unit (C) of the vehicle to provide information on the status of the kid lever (L). The control processing unit (C) detects the speed of the vehicle and compares it with a very low threshold value, for example 5 Km/h. In view of the above, the control processing unit (C) has two pieces of information:

when the vehicle is stopped or is traveling at a lower speed than the threshold speed;

when the vehicle is moving or is traveling at a lower speed than the threshold speed;

The control processing unit (C) is electrically connected to a first actuator (A1) that actuates the first Bowden cable (B1). The control processing unit (C) can be also electrically connected to a second actuator (A2) that actuates the second Bowden cable (B2).

When the vehicle is stopped, or is traveling at a lower speed than the threshold speed, the first actuator (A1) is inactive and does not pull the first Bowden cable (B1).

When the vehicle is traveling at a higher speed than the threshold speed and the sensor (W) detects an initial movement of the kid lever (L), the first actuator (A1) is activated by the control processing unit (C), in such a way as to push the first Bowden cable (B1) to move the pawl (3) and permit a partial opening of the lock. In these conditions, by pulling the kid lever (L), the lock cannot be completely opened, in such a way as to prevent the opening of the lid of the hood when the vehicle is moving.

When the vehicle is traveling at a lower speed than the threshold, the control processing unit (C) deactivates the first actuator (A1) in such a way that the lock can be completely opened by means of the kid lever (B3).

When the vehicle is stopped, eventually, the control processing unit (C) can also actuate the second actuator (A2) that pulls the second Bowden cable (B2) to open the lock completely and open the lid of the hood.

Figure 14:
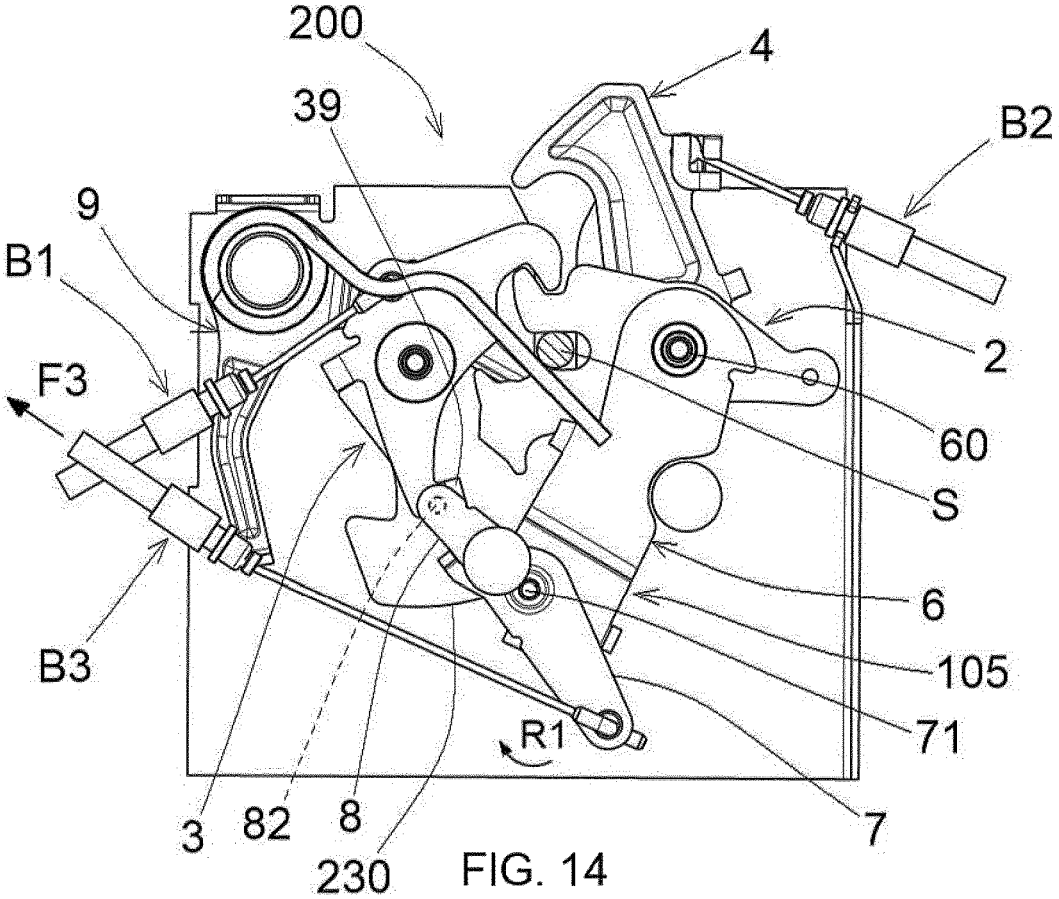
FIGS. 14, 15, 16 and 17 are plan views of the lock of FIG. 8 in a complete configuration, when the vehicle is stopped, which show the lock in complete closing position, in intermediate position during the actuation of the kid lever, in completely open position before resetting the lock and in completely opening position after resetting the lock.

FIG. 14 shows the lock (200) in a complete configuration, in completely closed position.

A kid inside the hood can actuate the kid lever (L) connected to the third Bowden cable (B3). The vehicle is stopped or is traveling at a lower speed than the threshold speed, so the first Bowden cable (B1) is not pulled by the first actuator (A1).

The third Bowden cable (B3) is pulled in the direction of the arrow F3. Consequently, the second lever (7) of the lever mechanism rotates in clockwise direction, in the direction of the arrow R1 around its pin (71), which slides on the cam surface (230) of the second element of the pawl (3), until it penetrates the seat (234) of the second element of the pawl, locking the lever (6).

Figure 15:
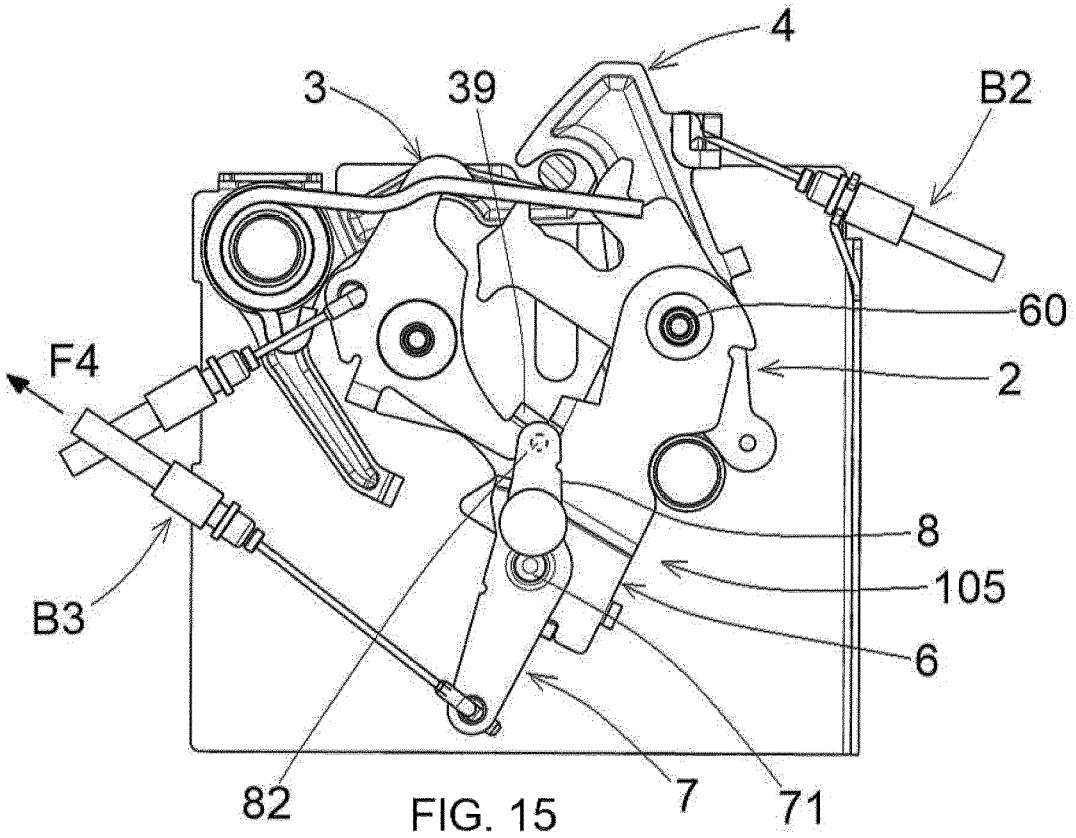

The projecting pin (82) of the third lever (8) pushes the second projection (39) of the first element of the pawl in such a way as to rotate the pawl (3) that releases the striker (S), as shown in FIG. 15, By pulling the third Bowden cable (B3) in the direction of the arrow F4, also the first lever (6) of the lever mechanism rotates around its pivoting hole (60).

Figure 16:
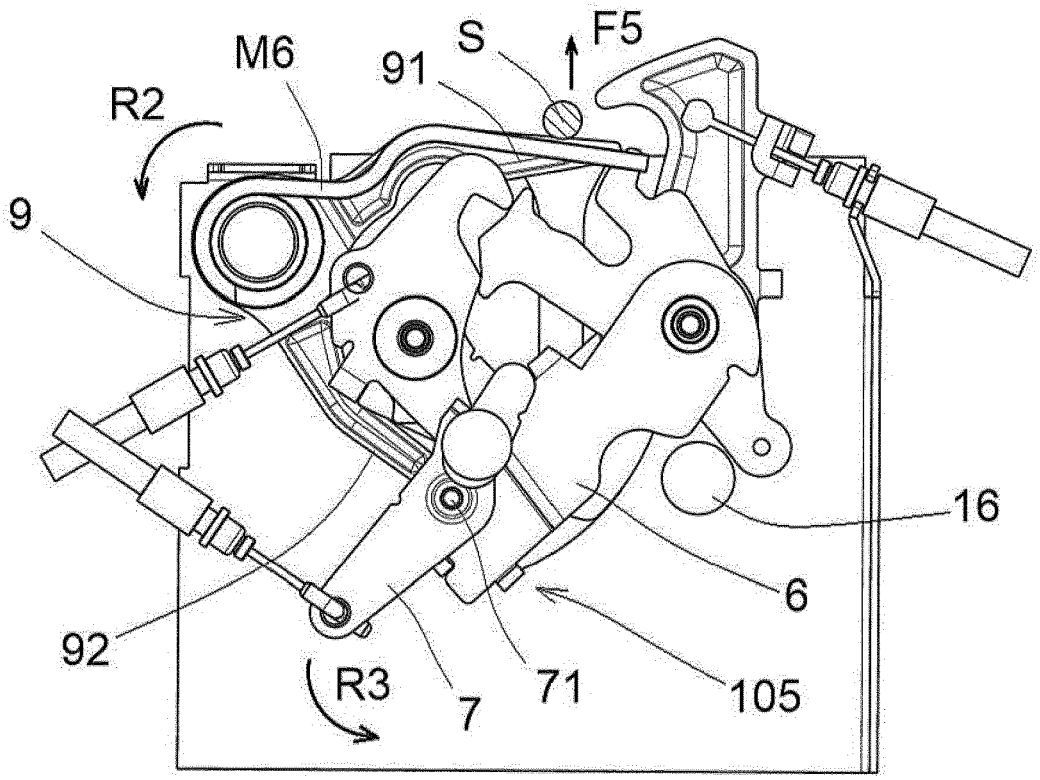

At the same time, the first stop surface (63) of the first lever (6) of the lever mechanism is stopped against the stop projection (46) of the safety lever (4) (not shown in the figures) to rotate the safety lever (4) in such a way as to permit a total opening of the lock, as shown in FIG. 16.

Now, the lid of the hood can be opened. The striker (S) rests on the spring (M6) that pushes in the direction of the arrow F5. During the opening of the hid of the hood, the striker (S) releases the first arm (91) of the reset device (9).

Figure 17:
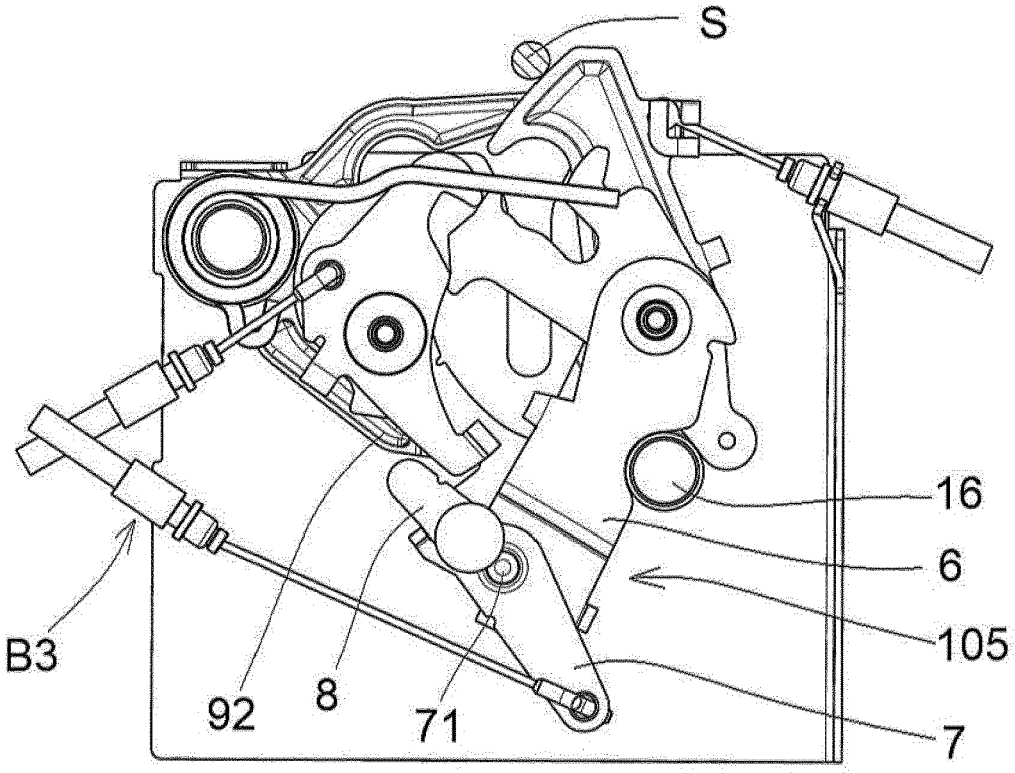

Therefore, the reset device (9) rotates in the direction of the arrow R2, pushing the surface of the pawl between the stop (237) and the housing (234) of the second element (203') of the pawl, which rotates, releasing the projecting pin (71) of the second lever of the lever mechanism from the seat (234) of the second element of the pawl. Consequently, the lever mechanism (105) can rotate in the direction of the arrow R3 in order to reset, because the spring of the first lever (6) and the spring of the second lever (7) of the lever mechanism return the first lever (6) and the second lever (7) of the lever mechanism to the initial position, as shown in FIG. 17, which shows the lever mechanism (105) in reset status and ready to be actuated by the third Bowden cable (B3).

Going back to FIG. 14, the lock is completely closed and the vehicle travels at a higher speed than the threshold speed.

Figure 18:
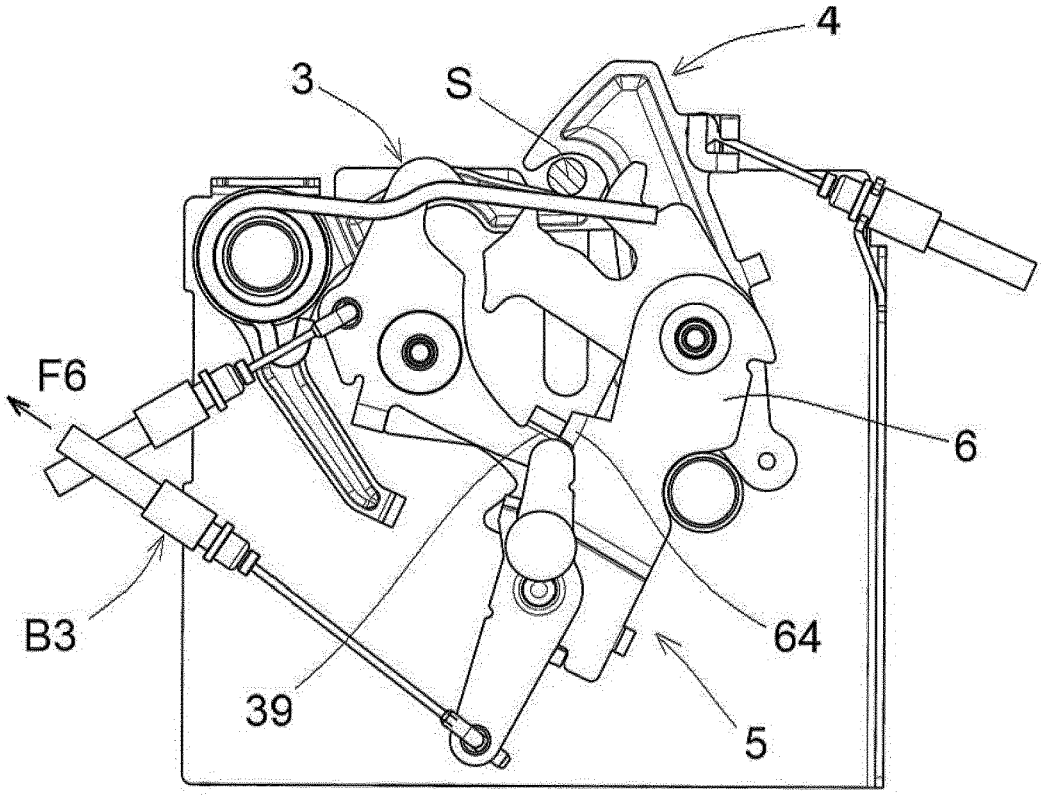
FIG. 18 is a plan view of the lock of FIG. 8 in a complete configuration, when the vehicle is moving, while the kid lever is pulled.

The kid in the hood actuates the kid lever (L). the sensor (W1) detects the actuation of the kid lever and the control processing unit (C) activates the first actuator (A1) that pulls the first Bowden cable (B1), rotating the pawl (3), as shown in FIG. 18. The striker (S) is held by the safety lever (4) and therefore the lid of the hood cannot be opened.

By pulling the third Bowden cable (B3) in the direction of the arrow F6, the second stop surface (64) of the first lever of the lever mechanism is stopped against the first stop surface (39) of the first element of the pawl (3), therefore the first lever (6) of the lever mechanism is not moved and cannot unlock the safety lever (4).

Figure 19:
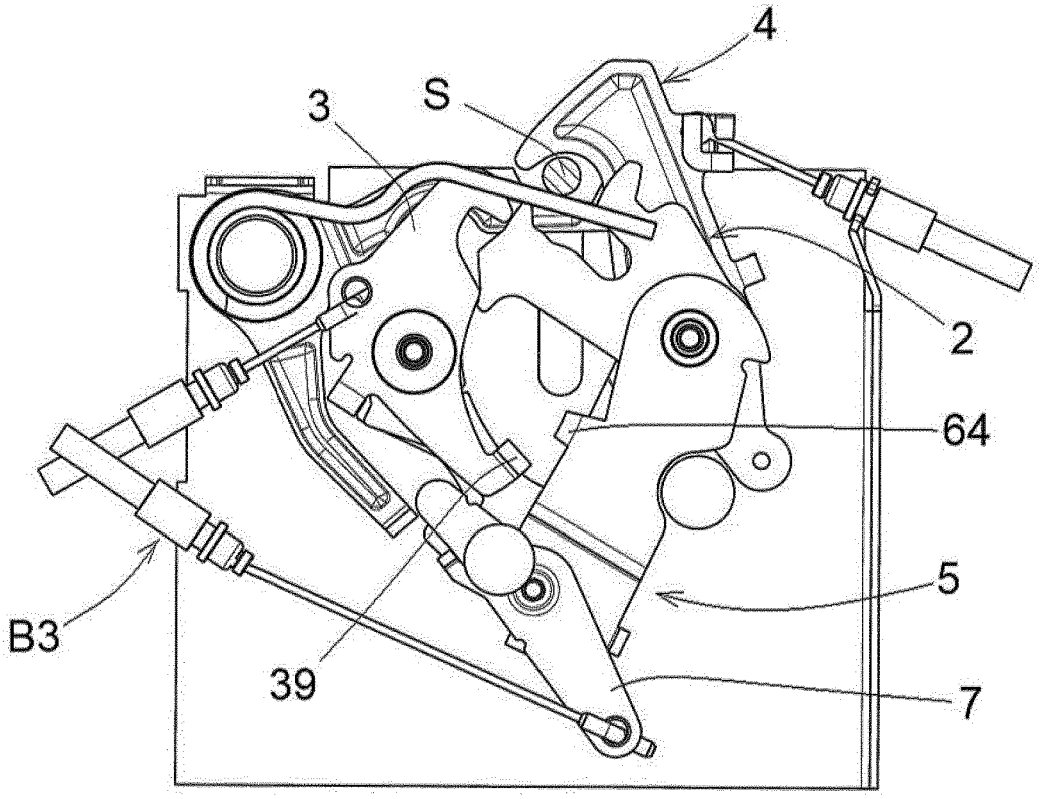
FIG. 19 is a plan view of the lock of FIG. 18, when the vehicle is stopped.

When the vehicle is traveling at a lower speed than the threshold speed, the control processing unit (C) deactivates the first actuator (A1) that pulls the first Bowden cable (B1), so the pawl (3) is stopped against the striker (2) as shown in FIG. 19. In such a situation, the lock can be opened completely, by means of the kid lever (L), pulling the third Bowden cable (B3) because the second stop surface (64) of the first lever of the lever mechanism is not stopped against the first stop surface (39) of the first element of the pawl (3), therefore the first stop surface (63) of the first lever (6) of the lever mechanism can be stopped against the stop projection (46) of the safety lever (4) to rotate the safety lever (4) in such a way as to permit a total opening of the lock.

It must be noted that the control processing unit (C) of the vehicle (electrically) implements a memory function of the second actuator (A2).

If the kid lever (L) is pulled when the vehicle is traveling, the safety lever (4) remains locked. Such a lock command of the safety lever is saved in the control processing unit (C). Therefore, when the vehicle stops or slows down under a speed threshold, the control processing unit (C) of the vehicle controls the second actuator (A2) in such a way as to release the safety lever (4), without the kid lever (L) being pulled again by the kid.

On the contrary, if the kid lever (L) is pulled when the vehicle is stopped, and nobody has lifted the lid, and the vehicle starts moving again, then the first actuator (A1) actuates the pawl (3) by pulling the Bowden cable (B1). So, a projecting foot (37) (FIG. 8A) of the first element of the pawl that is already stopped against the second element (203') of the pawl pushes the second element (203') of the pawl, which releases the pin (71) of the second lever that is pivoted on the first lever (6) that is fastened in the seat (234) of the second element (203') of the pawl. Therefore, the first lever (6) of the lever mechanism rotates until it is stopped against the pin (16) that is integral with the box, unlocking the safety lever (4), which closes.

Numerous equivalent variations and modifications can be made to the present embodiments of the invention, which are within the reach of an expert of the field, falling in any case within the scope of the invention.

The invention claimed is:

1. A lock for a motor vehicle hood, the lock comprising:

a catch pivoted to a box so as to be movable between a closing position and an opening position, the catch fastening a striker adapted to be fixed to a body of the motor vehicle in the closing position, the catch not fastening the striker in the opening position, said catch having a slot suitable for fastening the striker when the striker is engaged in the slot, said catch having a retention member, a stop, and a cam;

a pawl pivoted to the box so as to move from a closing position to an opening position, the closing position of said pawl blocking said catch in the closing position of said catch, the opening position of said pawl not blocking said catch in the closing position of said catch, said pawl having another retention member cooperative with the retention member of said catch so as to block said catch in the closing position of said catch, said pawl having another stop suitable for being stopped against the stop of said catch so as to hold said pawl in the opening position of said pawl, said pawl having another cam cooperative with the cam of said catch in the opening position of said catch so as to move said pawl during movement of said catch from the opening position to the closing position of said catch, said pawl having a fastening seat;

a safety lever pivoted to the box so as to move from a closing position to an opening position, said safety lever fastening the striker in the closing position of said safety lever, said safety lever not fastening the striker in the opening position of said safety lever, said safety lever having a blocking seat, suitable for blocking the striker when said safety lever is in the closing position, said safety lever having a fastening pin fastenable with the fastening seat of said pawl so as to hold said safety lever in the opening position of said safety lever;

a first spring urging said catch toward the opening position of said catch;

a second spring urging said pawl toward the closing position of said pawl;

a third spring urging the safety lever toward the closing position of said safety lever;

a first Bowden cable connected to said pawl and adapted to pull said pawl toward the opening position of said pawl; and a second Bowden cable connected to said safety lever and adapted to pull said safety lever toward the opening, position of said safety lever.

2. The lock of claim 1, wherein the retention member of said catch and said other retention member of said pawl comprise retention teeth and retention seats.

3. The lock of claim 1, wherein the stop of the catch and said other stop of said pawl comprise stop surfaces.

4. The lock of claim 1, wherein the cam comprises a cam surface.

5. A lock for a motor vehicle hood, the lock comprising:

a catch pivoted to a box so as to be movable between a closing position and an opening position, the catch fastening a striker adapted to be fixed to a body of the motor vehicle in the closing position, the catch not fastening the striker in the opening position, said catch having a slot suitable for fastening the striker when the striker is engaged in the slot, said catch having a retention member, a stop, and a cam;

a pawl pivoted to the box so as to move from a closing position to an opening position, the closing position of said pawl blocking said catch in the closing position of said catch, the opening position of said pawl not blocking said catch in the closing position of said catch, said pawl having another retention member cooperative with the retention member of said catch so as to block said catch in the closing position of said catch, said pawl having another stop suitable for being stopped against the stop of said catch so as to hold said pawl in the opening position of said pawl, said pawl having another cam cooperative with the cam of said catch in the opening position of said catch so as to move said pawl during movement of said catch from the opening position to the closing position of said catch, said pawl having a fastening seat;

a safety lever pivoted to the box so as to move from a closing position to an opening position, said safety lever fastening the striker in the closing position of said safety lever, said safety lever not fastening the striker in the opening position of said safety lever, said safety lever having a blocking seat suitable for blocking the striker when said safety lever is in the closing position;

a first spring urging said catch toward the opening position of said catch;

a second spring urging said pawl toward the closing position of said pawl;

a third spring urging the safety lever toward the closing position of said safety lever;

a first Bowden cable connected to said pawl and adapted to pull said pawl toward the opening position of said pawl;

a second Bowden cable connected to said safety lever and adapted to pull said safety lever toward the opening position of said safety lever;

an auxiliary lever pivoted to the box so as to move from an opening position to a closing position, said auxiliary lever not cooperating with said catch in the opening position of said auxiliary lever, said auxiliary lever cooperating with said catch in the closing position of said auxiliary lever, said auxiliary lever having a stop seat stoppable against a pin of said catch so as to push said catch toward the closing position of said catch;

a fourth spring urging said auxiliary lever toward the opening position of said auxiliary lever; and a third Bowden cable connected to said auxiliary lever so as to pull said auxiliary lever toward the closing position of said auxiliary lever.

6. The lock of claim 5, further comprising:

an actuator connected to said third Bowden cable; and a position sensor that detects a position of the striker when the striker enters the slot of said catch, said position sensor being connected to said actuator so as to actuate said actuator when said position sensor detects the entry of the striker into the slot of the catch.

* * * * *